US010540841B2

(12) United States Patent
Penacho et al.

(10) Patent No.: US 10,540,841 B2
(45) Date of Patent: Jan. 21, 2020

(54) ENHANCED VISUALIZATION OF OPTIMIZED SYMBOL COMBINATIONS IN RESPONSE TO AUTOMATICALLY DETERMINED SYMBOL SHIFT CONDITIONS

(71) Applicant: Aristocrat Technologies Australia Pty Limited, North Ryde, NSW (AU)

(72) Inventors: Gary Joseph Penacho, Henderson, NV (US); Thomas Tuomey, Las Vegas, NV (US)

(73) Assignee: ARISTOCRAT TECHNOLOGIES AUSTRALIA PTY LIMITED, North Ryde (AU)

( * ) Notice: Subject to any disclaimer, the term of this patent is extended or adjusted under 35 U.S.C. 154(b) by 9 days.

(21) Appl. No.: 15/916,038

(22) Filed: Mar. 8, 2018

(65) Prior Publication Data

US 2019/0073858 A1 Mar. 7, 2019

Related U.S. Application Data

(60) Provisional application No. 62/553,983, filed on Sep. 4, 2017.

(51) Int. Cl.
*G07F 17/32* (2006.01)

(52) U.S. Cl.
CPC ..... *G07F 17/3213* (2013.01); *G07F 17/3267* (2013.01); *G07F 17/329* (2013.01); *G07F 17/3216* (2013.01); *G07F 17/3246* (2013.01); *G07F 17/3251* (2013.01); *G07F 17/3258* (2013.01); *G07F 17/3293* (2013.01)

(58) Field of Classification Search
None
See application file for complete search history.

(56) References Cited

U.S. PATENT DOCUMENTS

| | | | | |
|---|---|---|---|---|
| 9,159,200 | B2 * | 10/2015 | Aoki | G07F 17/3262 |
| 9,251,670 | B2 * | 2/2016 | Aoki | G07F 17/34 |
| 2016/0379451 | A1 * | 12/2016 | Kup-Ferroth | G07F 17/32 463/21 |
| 2017/0092049 | A1 * | 3/2017 | Bolling, Jr. | G07F 17/3209 |
| 2018/0089929 | A1 * | 3/2018 | Hawkins | G07F 17/3213 |

* cited by examiner

*Primary Examiner* — Ronald Laneau
(74) *Attorney, Agent, or Firm* — McAndrews, Held & Malloy, Ltd.

(57) ABSTRACT

A gaming machine including a display device and game controller is provided. The display device includes reels having display positions for presenting symbols that include non-blank symbols and blank symbols. The game controller is configured to spin the reels horizontally to obtain a first game outcome including a first arrangement of the symbols at the display positions. In response to a determination that the first arrangement includes blank symbols, the game controller is configured to determine whether horizontally shifting non-blank symbols in either direction with respect to the blank symbols in each reel results in an optimal win. The game controller horizontally shifts the non-blank symbols with respect to the blank symbols in each reel to obtain a second game outcome in response to a determination that the shifting results in the optimal win. The game controller increases a credit balance by an award associated with the optimal win.

20 Claims, 14 Drawing Sheets

800a

800b

800c

ENHANCED VISUALIZATION OF OPTIMIZED SYMBOL COMBINATIONS IN RESPONSE TO AUTOMATICALLY DETERMINED SYMBOL SHIFT CONDITIONS

RELATED APPLICATIONS

This application claims priority to U.S. Provisional Patent Application No. 62/553,983 having a filing date of Sep. 4, 2017, which is incorporated herein by reference in its entirety.

BACKGROUND

In electronic gaming systems, a number of reels are spun to form an outcome. Each reel has a number of symbols. The outcome is evaluated based on the symbols spun up. While such gaming systems provide players with enjoyment, a need exists for new gaming systems in order to maintain or increase player enjoyment.

SUMMARY

Systems, apparatuses, and methods are disclosed for enhancing visualization of optimized symbol combinations in a spinning reel game based on automatically determined symbol shift conditions, substantially as shown in and/or described in connection with at least one of the figures, as set forth more completely in the claims.

Still other features, aspects, and advantages of embodiments will become more fully apparent from the following detailed description, the appended claims, and the accompanying drawings illustrating a number of example embodiments and implementations, including the best mode contemplated for carrying out the embodiments. Embodiments may also be capable of other and different applications, and several details may be modified in various respects, all without departing from the spirit and scope of the disclosed embodiments. Accordingly, the drawings and descriptions are to be regarded as illustrative in nature, and not as restrictive. The drawings are not necessarily drawn to scale.

DRAWING DESCRIPTIONS

In the drawings, various dimensions may be exaggerated for illustrative clarity. Additionally, like reference numbers are utilized to refer to like elements throughout the present disclosure.

DESCRIPTION

Figure 1:
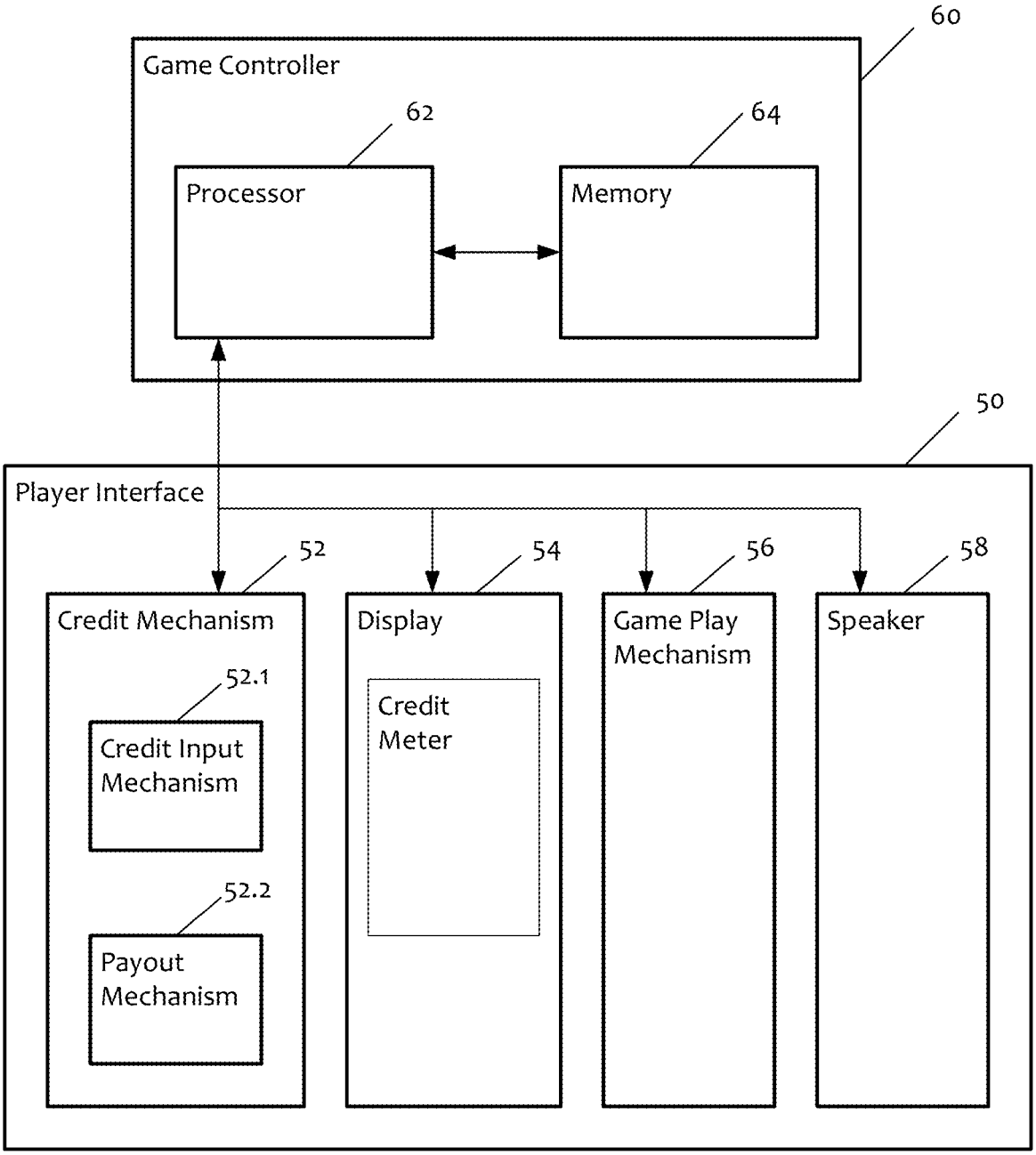
FIG. 1 is a block diagram of the core components of a gaming system in accordance with various aspects of the present disclosure.

Referring to the drawings, there is shown an embodiment of a gaming machine that includes a credit input mechanism, a credit meter, a display, a game controller, and a payout mechanism. The credit input mechanism is configured to receive a physical item to establish a credit balance. The credit balance is increasable and decreasable based at least on wagering activity. The credit meter is configured to monitor the credit balance. The display includes a plurality of display positions. The gaming machine includes a game controller configured to select a plurality of symbols, and causes the display to display the selected symbols at the display positions. The game controller is configured to determine if the selected symbols include a blank symbol. The game controller is configured to determine if shifting a displayed symbol will result in a win in response to determining that the selected symbols include a blank symbol. The game controller is configured to shift at least one symbol in response to determining that shifting a displayed symbol will result in a win. The payout mechanism is operable to cause a payout associated with the win.

General Construction of Gaming System

The gaming system can take a number of different forms. In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Referring to FIG. 1, the gaming system 1 has several core components. At the broadest level, the core components are a player interface 50 and a game controller 60. The player interface 50 enables manual interaction between a player and gaming system 1, and for this purpose includes input/output components required for the player to enter instructions to play a game and observe game outcomes.

Components of the player interface may vary from embodiment to embodiment but will typically include a credit mechanism 52 to enable a player to input credits. For example, in some embodiments, credit mechanism 52 may include a credit input mechanism 52.1 to receive a physical item representing a monetary value for establishing a credit balance. The credit balance may be increasable and decreasable based on wagering activities. Based on the established credit balance, the gaming system 1 initiates a game. In some embodiments, the credit mechanism 52 also includes a payout mechanism 52.2 to cause a payout associated with the credit balance. The player interface may also include one or more displays 54, a game play mechanism 56 including one or more input devices that enable a player to input game play instructions (e.g. to place a wager), and one or more speakers 58. In some embodiments, each of the displays 54 includes a plurality of display positions. In other embodiments, each of the displays 54 includes a plurality of display areas. Each of the display areas includes a plurality of display positions. In the embodiment shown, the display 54 also includes a credit meter 54.1. In some embodiments, credit meter 54.1 displays credits available, credits bet, and/or credits won.

Game controller 60 is in data communication with player interface 50 and typically includes a processor 62 that processes game play instructions in accordance with game play rules and outputs game play outcomes to the display(s) 54. Typically, the game play rules are stored as program code in a memory 64 but can also be hardwired. In some embodiments, the memory 64 may also store data indicative of a plurality of symbols, pay tables, images, and other information to be used in games. Herein the term "processor" is used to refer generically to any device that can process game play instructions in accordance with game play rules and may include: a microprocessor, microcontroller, programmable logic device or other computational device, a general purpose computer (e.g. a PC) or a server. That is, a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also known to provide a specific purpose processor using an application specific integrated circuit (ASIC) or a field programmable gate array (FPGA).

Figure 2:
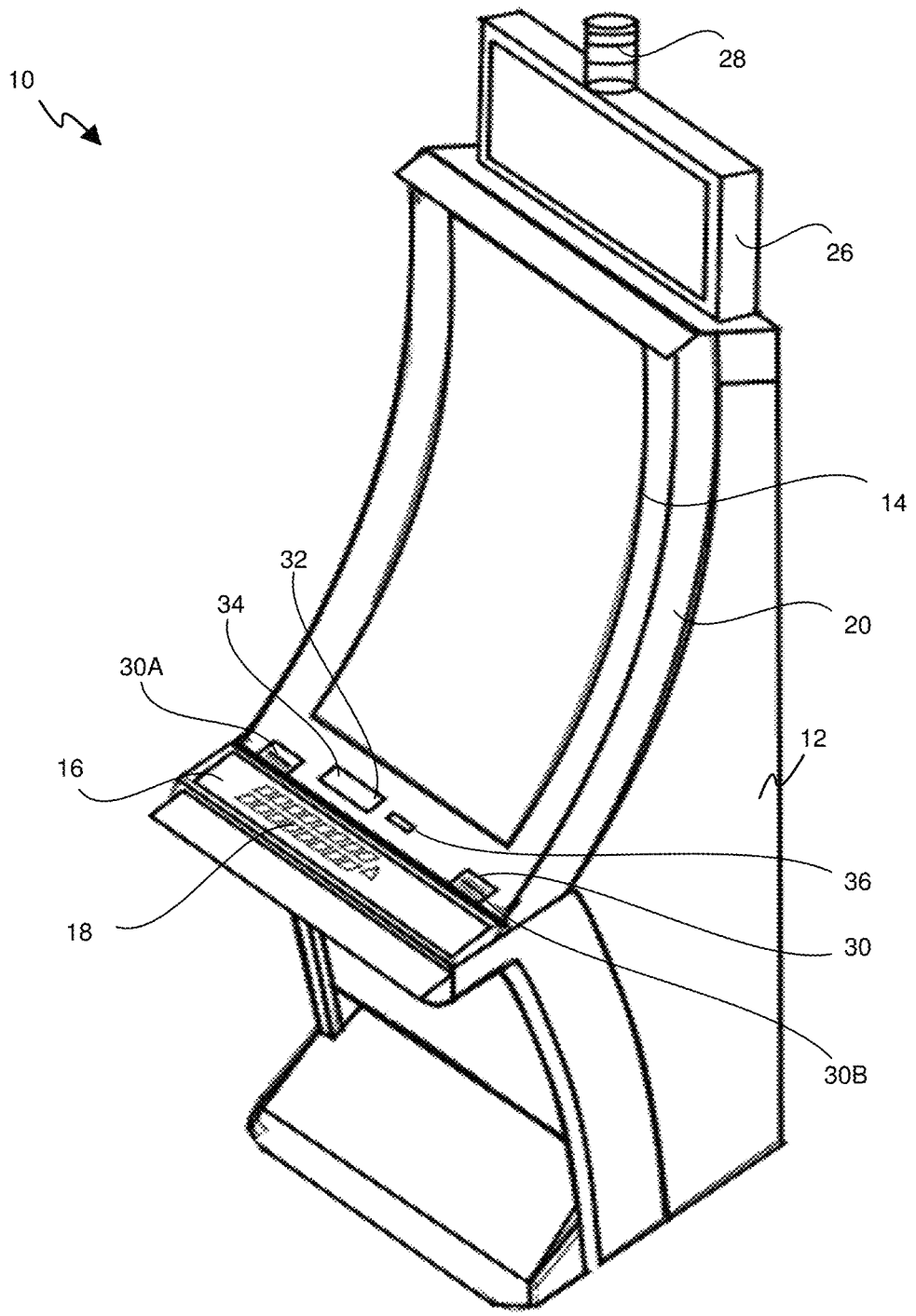
FIG. 2 is a perspective view of an exemplary gaming device in accordance with various aspects of the present disclosure.

FIG. 2 depicts an exemplary gaming device 10 in accordance with various aspects of the present disclosure. Referring to FIG. 2, the gaming device 10 may include a main cabinet 12 including a main door 20 which opens to provide access to the interior of the gaming device 10. In particular, the main cabinet 12 may house circuitry, electrical components, and electromechanical components of the gaming device 10. In particular, the main cabinet 12 may house a game controller (see, e.g., FIG. 1) configured to control the various components of the gaming device 10 and execute a wagering game as described in detail below. The main cabinet 12 may also include a button deck 16 with buttons 18, which a player may actuate in order to operate the gaming device 10 and play a wagering game. Various other components may be housed by the main cabinet 12 or mounted to the main cabinet 12. For example, the gaming device 10 includes a sound system and speakers 58 (as shown in FIG. 1) that may be mounted to or housed by the main cabinet 12 for playing game sound effects and music to enhance the player's game play experience.

A credit input mechanism 30 such as a bill validator or coin-in slot may also be mounted to the main cabinet 12. The credit input mechanism 30 may receive physical items associated with a monetary value such as coins, bills, etc. to permit the gaming device to establish an associated credit value of a credit meter. In some embodiments, a credit output mechanism such as coin tray or coin chute may also be mounted to the main cabinet 12. Such credit output mechanism may permit the gaming device 10 to dispense coins when a player cashes out any remaining credits on the credit meter or to dispense winning directly to the player in lieu of increasing the credit meter.

As shown, the gaming device 10 includes a main display 14 mounted above the button deck 16. The main display 14 may include a high-resolution LCD, plasma, LED, or OLED panel which may be in a portrait configuration with curvature radius from top to bottom as shown.

In some embodiments, the bill validator 30 may also function as a "ticket in" reader 30B that allows the player to use a casino issued credit ticket to load credit onto the gaming device 10 (e.g., in a cashless ticket system). In such cashless embodiments, the gaming device 10 may also include a "ticket out" printer 30A for outputting a credit ticket when a "cash out" button is pressed. Cashless ticket systems may be used to generate and track unique bar-codes that are printed on tickets. Such tickets allow players to avoid the use of bills and coins for loading credits on a credit meter of the gaming device 10. Instead, players may load credits using a ticket reader 30B and may cash out credits from the credit meter through the use of the ticket printer 30A.

In some embodiments, the gaming device 10 may include a player tracking interface that includes a card reader 36, a transceiver for wireless communication with a player's smartphone, a key pad 32, and/or an illuminated display 34 for reading, receiving, entering, and/or displaying player tracking information. In such embodiments, the gaming device 10 may communicate with the server via the player tracking interface to send and receive player tracking information.

In various embodiments, the gaming device 10 may not include physical reels and instead shows game play functions on the main display 14. The gaming device 10 may further include an optional topper screen 26. The topper screen 26 may be used as a secondary game display for bonus play or may be used to show game features or attraction activities while the game is not in play. The topper screen 26 may also display any other information or media desired by the game designer or operator. In some embodiments, the topper screen 26 may also be used to display progressive jackpot prizes available to a player during play of gaming device 10.

A candle 24 may be mounted on the top of gaming device 10. In some embodiments, a player may activate the candle 24 via a button 18 in order to inform operations staff that the gaming device 10 has experienced a malfunction or that the player requires service.

While an example gaming device 10 has been described in regard to FIG. 2, certain aspects of the present disclosure may be implemented by gaming devices that lack one or more of the above-described components. For example, not all gaming devices suitable for implementing aspects of the present disclosure necessarily include top boxes, information panels, cashless ticket systems, and/or player tracking systems. Further, some suitable gaming devices may include a single game display having a mechanical reels or a video display. Moreover, other embodiments may be designed for bar tables and have displays that face upwards.

Many different types of wagering games, including mechanical slot games, video slot games, video poker, video black jack, video pachinko, keno, bingo, and lottery, may be provided by the gaming device 10. In particular, a gaming device 10 may be operable to provide many different instances of games of chance. The instances may be differentiated according to themes, sounds, graphics, type of game (e.g., slot game vs. card game vs. game with aspects of skill), denomination, number of paylines, maximum jackpot, progressive or non-progressive, bonus games, class 2 or class 3, etc.

The gaming device 10 may allow a player to select a game of chance, skill, or combination thereof, to play from a plurality of instances available on the gaming device 10. For example, the gaming device 10 may provide a menu with a list of the instances of games that are available for play on the gaming device 10 and a player may be able to select from the list a game that they wish to play.

Figure 3:
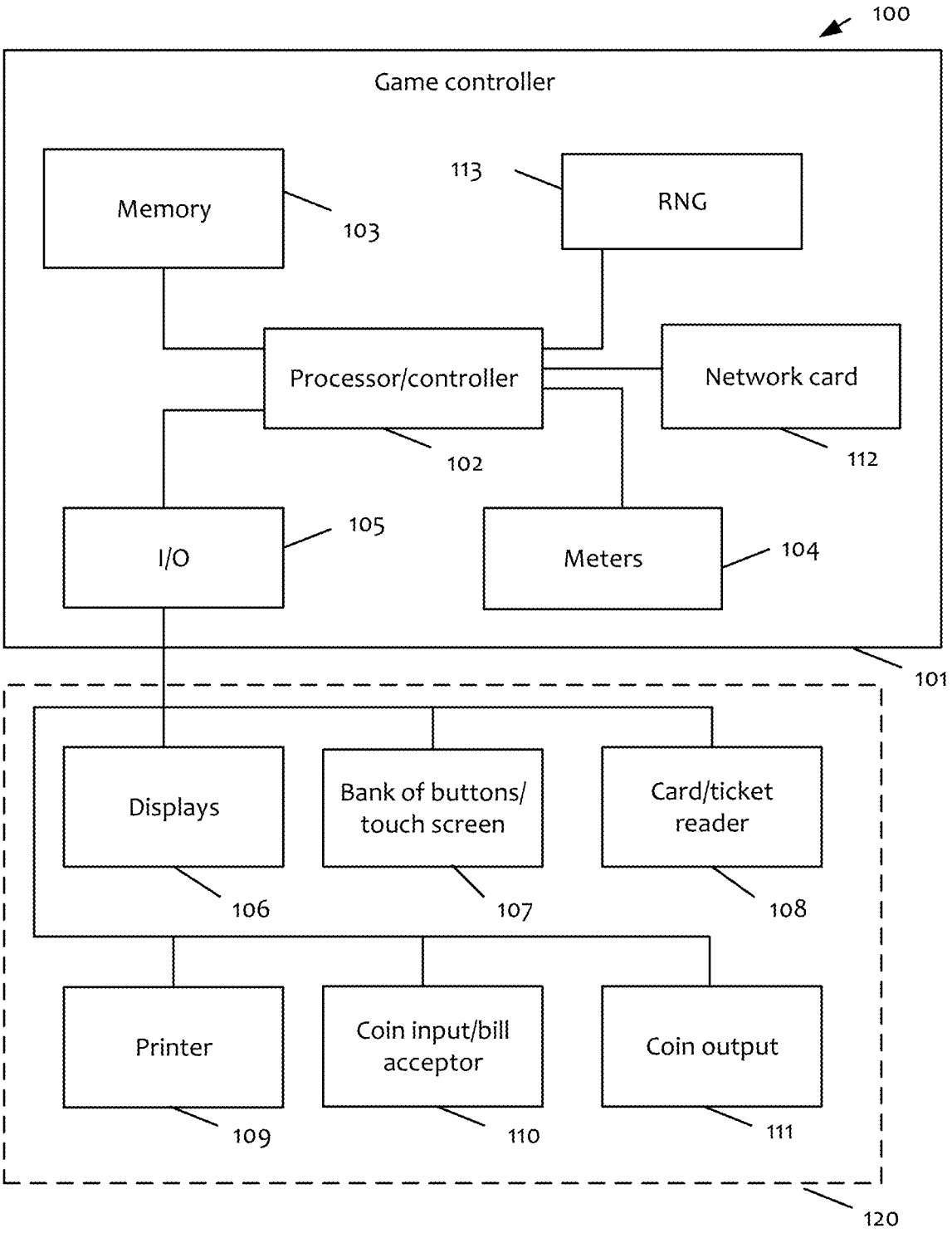
FIG. 3 is a block diagram of the functional components of a gaming machine in accordance with various aspects of the present disclosure.

FIG. 3 shows a block diagram of operative components of a typical gaming machine which may be the same as or different to the gaming machine of FIG. 2.

As shown in FIG. 3, a gaming machine 100 includes a game controller 101 having a processor 102 mounted on a circuit board. Instructions and data to control operation of processor 102 are stored in a memory 103, which is in data communication with the processor 102. Typically, gaming machine 100 will include both volatile and non-volatile memory and more than one of each type of memory, with such memories being collectively represented by the memory 103.

Gaming machine 100 has credit meters 104 for purposes including ensuring regulatory compliance and monitoring player credit, and an input/output (I/O) interface 105 for communicating with peripheral devices of the gaming machine 100. Input/output (I/O) interface 105 and/or the peripheral devices may be intelligent devices with their own memory for storing associated instructions and data for use with the input/output interface or the peripheral devices. A random number generator module 113 generates random numbers for use by processor 102. Persons skilled in the art will appreciate that the reference to random numbers includes pseudo-random numbers.

In the example shown in FIG. 3, a player interface 120 includes peripheral devices that communicate with game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game, any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, gaming machine 100 may include a communications interface, for example a network card 112. Network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
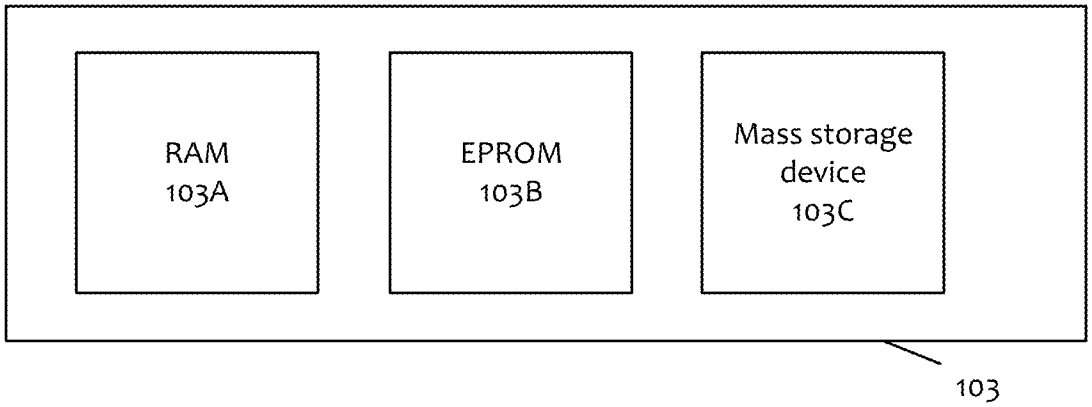
FIG. 4 is a schematic diagram of the functional components of a memory in accordance with various aspects of the present disclosure.

Referring now to FIG. 4, the main components of an exemplary memory 103 include RAM 103A, EPROM 103B and a mass storage device 103C. RAM 103A typically temporarily holds program files for execution by processor 102 and related data. EPROM 103B may be a boot ROM device and/or may contain some system or game related code. Mass storage device 103C is typically used to store game programs, the integrity of which may be verified and/or authenticated by the processor 102 using protected code from EPROM 103B or elsewhere.

It is also possible for the operative components of gaming machine 100 to be distributed, for example, input/output devices 106, 107, 108, 109, 110, 111 may be provided remotely from the game controller 101.

Figure 5:
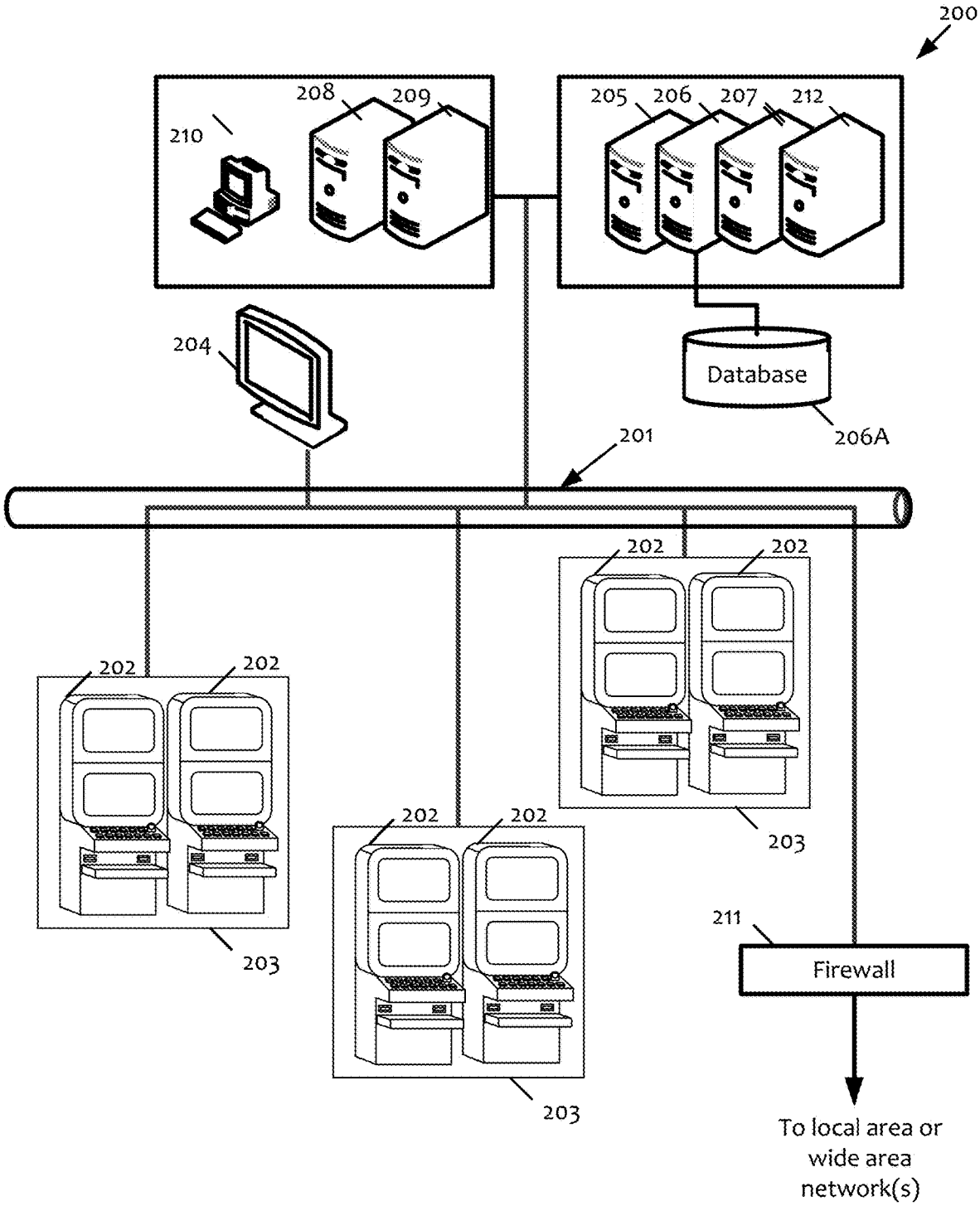
FIG. 5 is a schematic diagram of a network gaming system in accordance with various aspects of the present disclosure.

FIG. 5 shows a gaming system 200 in accordance with an alternative embodiment. Gaming system 200 includes a network 201, which for example may be an Ethernet network. Gaming machines 202, shown arranged in three banks 203 of two gaming machines 202 in FIG. 5 are connected to network 201. Gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to network 201. For example, displays 204 may be associated with one or more banks 203 of gaming machines. Displays 204 may be used to display representations associated with game play on gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by gaming machines 202 in a database 206A. Typically, if the gaming system enables players to participate in a jackpot game, a jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client server configurations are possible, and further details of a client/server architecture can be found in WO 2006/052213 and PCT/SE2006/000559, the disclosures of which are incorporated herein by reference.

Servers are also typically provided to assist in the administration of the gaming system 200, including for example a gaming floor management server 208, and a licensing server 209 to monitor the use of licenses relating to particular games. An administrator terminal 210 is provided to allow an administrator to run network 201 and the devices connected to the network.

Gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, game server 205 could run a random number generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

When the credit input mechanism 52.1 (of FIG. 1) has received a physical item representing a monetary value, a credit balance is established. The player may then operate the game play mechanism 56 (of FIG. 1) to specify one or more of a plurality of wagers for the base game and to initiate a play of the base game. In an exemplary embodiment, at least certain of the wagers that the player can wager entitles the player to win a chance to play a feature game, for example, when a trigger condition occurs. In some embodiments, when the credit input mechanism 52.1 (of FIG. 1) has received a physical item representing a monetary value for establishing a credit balance, at least a portion of the received physical item may initiate a play of the base game directly.

Figure 6:
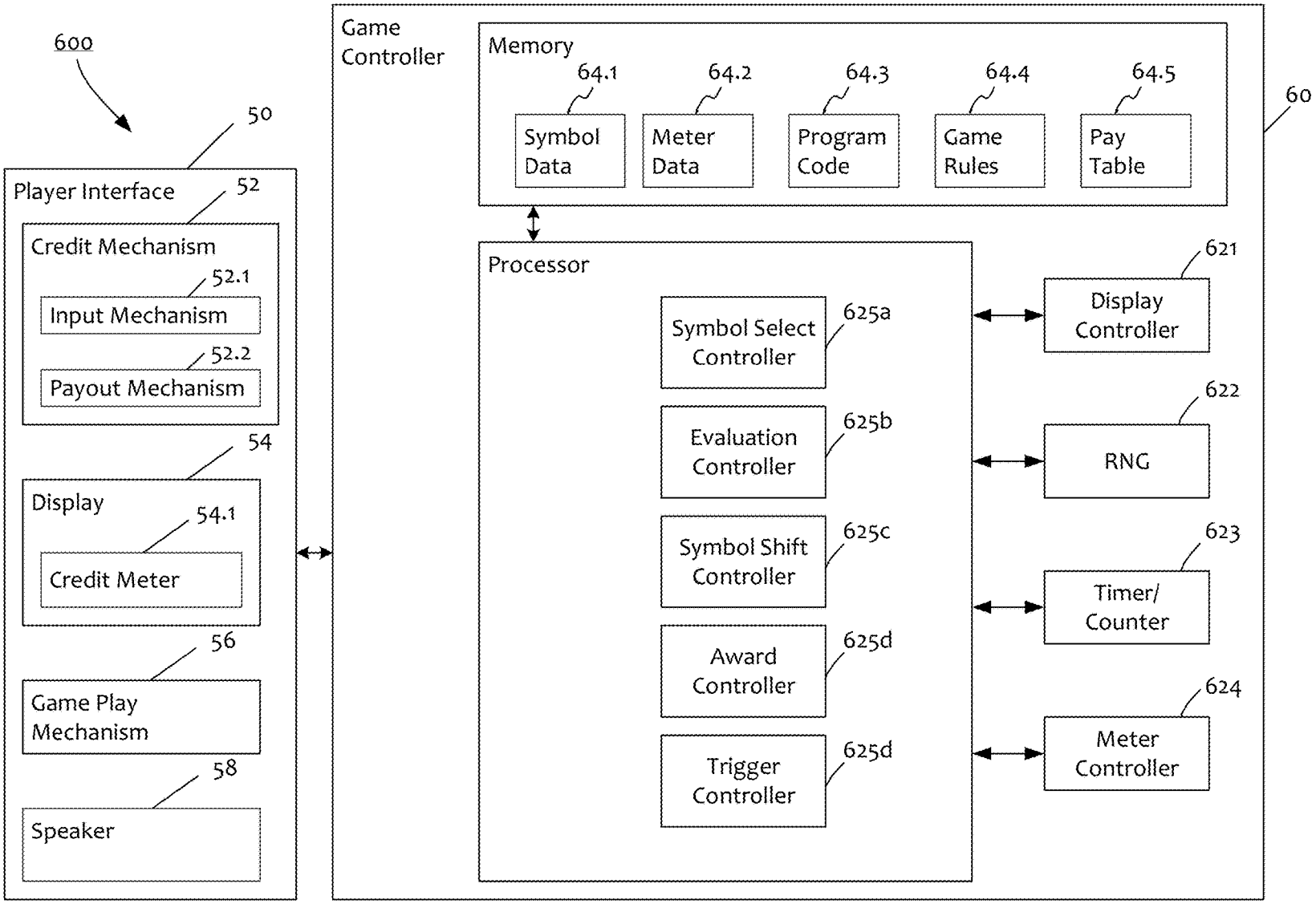
FIG. 6 is an exemplary gaming machine in block diagram form in accordance with various aspects of the present disclosure.

Referring to FIG. 6, a gaming machine 600 (similar to the gaming machine 10 of FIG. 2) includes a game controller 60. Game controller 60 includes a processor 62 and a memory 64. Memory 64 includes a symbol memory module 64.1 that stores data of a plurality of symbols, a meter memory module 64.2 that stores meter data of gaming machine 600, and a program code memory 64.3 that stores program code to implement a number of modules to be executed by processor 62. In the embodiment described, memory 64 also includes a game rule memory module 64.4 that stores a plurality of game rules that specify how a game is played. In some embodiments, the game rules may specify that, after all reels have stopped spinning, non-blank symbols on a first reel may move into other positions on the first reel, provided that a sequential order of non-blank symbols is preserved. That is, non-blank symbols may not move over or through other non-blank symbols. The game rules may also specify that blank spaces or symbols on a reel allow other non-blank symbols in the reel to shift their positions. The game rules may also specify that positions that all non-blank symbols move to may provide a higher or optimum overall winning combination possible for a spin. The game rules may also specify that non-blank symbols can be shifted in any direction that has a blank symbol on a reel. Memory 64 also includes a pay table memory module 64.5 that stores a plurality of pay tables. For example, the pay tables may specify an award when an optimum overall winning combination is obtained.

Persons skilled in the art will appreciate that some or all of the components of the game controller 60 could be alternatively implemented. For example, in some embodiments, the game controller 60 and its components are implemented in the form of a dedicated circuit, or an individual application-specific-integrated-circuit (ASIC). In other embodiments, game controller 60 and its components is implemented as an individual ASIC. In other embodiments, some or all of the game controller components may be individually or collectively implemented as software modules, controllers, and/or circuitries.

In the embodiment shown, game controller 60 includes a display controller 621 which is configured to control display 54, a random number generator (RNG) 622 configured to generate a random number, and a timer/counter 623 configured to time and/or count an amount of time and/or a number of games that a base game and/or a feature game has been played, for example, without a win, an upgrade, and/or a trigger event. Game controller 60 also includes a meter controller 624 configured to generate, monitor and/or maintain meter data, for example, for display or storage based on game play, and/or to read meter data from the meter data memory module 64.2.

In the embodiment shown, the processor 62 includes a symbol select controller **625*a* that communicates with the display controller 621, the RNG 622, the timer/counter 623, and/or the meter controller 624. In some embodiments, the symbol select controller 625*a* randomly selects symbols from the symbol data memory module 64.1 for display on the display 54 via the RNG 622. The display controller 621 then causes the display 54** to display the selected symbols at a plurality of display positions. The displayed symbols thus form an outcome from the symbols displayed at the display positions.

In the embodiment shown, the processor 62 includes an evaluation controller **625*b* that evaluates the symbols selected for display to determine if the selected symbols form a winning outcome. The evaluation controller 625*b* may also evaluate the displayed symbols based on data from the game rule memory module 64.4 and the pay table memory module 64.5** to determine if an additional and/or an optimal win can be formed from the selected symbols when one or more, or all of the selected symbols are shifted.

In the embodiment shown, the evaluation controller **625*b* determines whether a selected symbol can be moved based on data from the game rule memory module 64.4 and the pay table memory module 64.5. For example, as detailed hereinafter, when a selected symbol is adjacent a blank space, the evaluation controller 625*b* determines that the selected symbol can be moved. The evaluation controller 625*b* evaluates all possible combinations of symbol shifts and the corresponding outcomes of each of the possible combinations as defined by data from the pay table memory module 64.5 to determine the optimal win. The optimal win as defined herein refers to arrangement of the symbols that provides the largest possible award as set forth in the pay table memory module 64.5. In the embodiment shown, the processor 62** also includes a symbol shift controller 625*c* that shifts the selected symbol into the blank space if the shifted symbol can form an additional and/or optimal win with other selected symbols as determined by the evaluation controller 625*b*.

The symbol shift controller 625*c* may shift a selected symbol in a direction that results in an additional and/or an optimal win. The symbol shift controller 625*c* shifts the selected symbol in a particular shift direction as determined by the evaluation controller 625*b* based on data from the pay table memory module 64.5. For example, if a selected symbol is sandwiched between two blank spaces, for example, a left blank space and a right blank space, the symbol shift controller 625*c* may shift the selected symbol to the right blank space (even if shifting to the left blank space may result in an additional win) when shifting to the right blank space results in a higher win or an optimal win.

When a plurality of combinations will produce the same optimal win, the combination that is most similar to the initial reel positions may be selected and displayed.

When there is no blank symbol selected for display on a reel, there is only one possible symbol combination for the reel. When there are one or five blank symbols selected for display on a reel, there are six possible symbol combinations for the reel. When there are two or four blank symbols selected for display on a reel, there are fifteen possible symbol combinations for the reel. When there are three blank symbols selected for display on a reel, there are twenty possible symbol combinations for the reel. The total number of possible symbol combinations per spin is a product of the possible symbol combinations for each of a plurality of reels. For example, if five reels are being used on the display 54, the number of possible symbol combinations ranges from 1 to 3.2 million ($20^5$).

Figure 7:
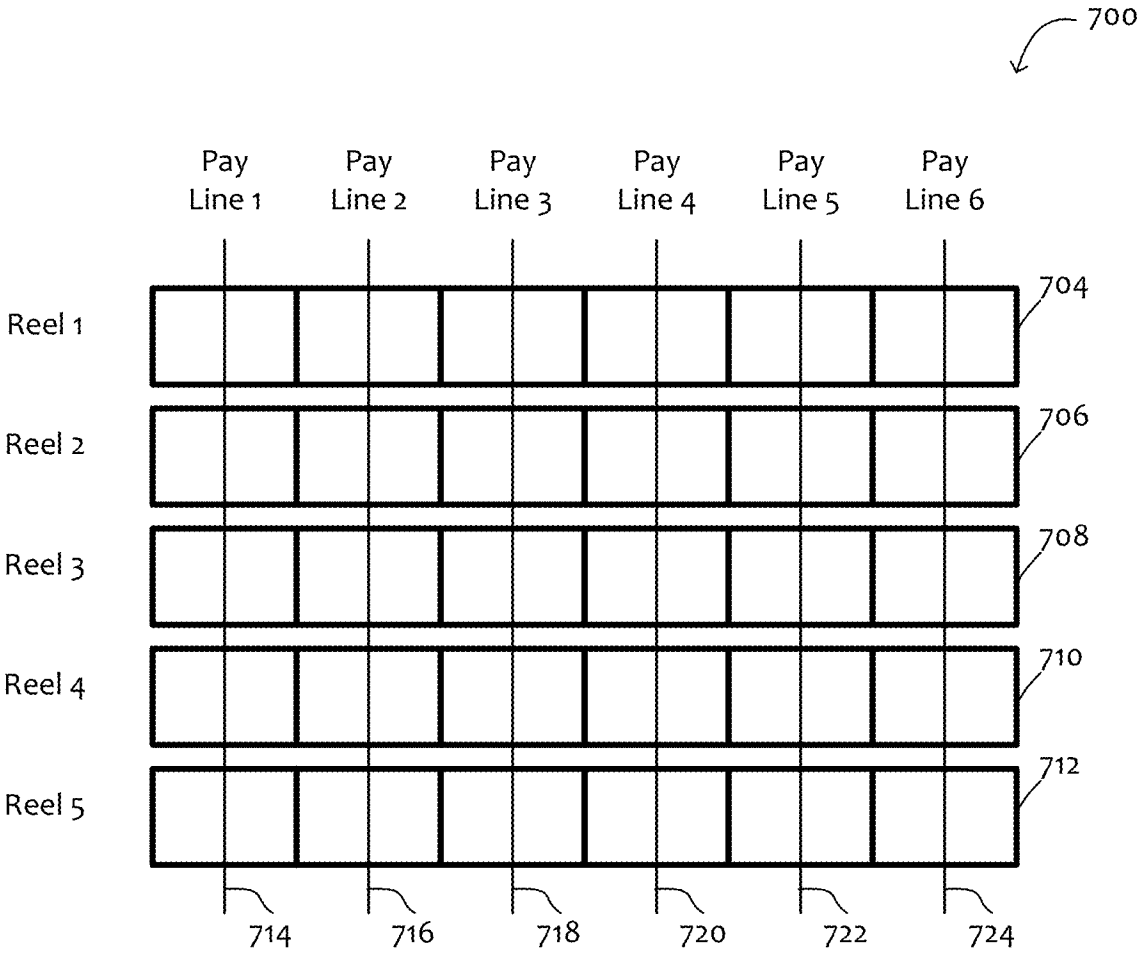
FIG. 7 is an exemplary feature game symbol matrix in accordance with various aspects of the present disclosure.

FIG. 7 is an exemplary feature game symbol matrix 700 displayed on display 54 (of FIG. 1). The symbol matrix 700 includes five horizontal reels 704, 706, 708, 710, 712, and six vertical play lines 714, 716, 718, 720, 722, 724. The horizontal reels 704, 706, 708, 710, 712 spin horizontally. When the symbol select controller 625*a* has randomly selected symbols from the symbol data memory module 64.1 for display on the display 54, the display controller 621 populates each of the horizontal reels 704, 706, 708, 710, 712 with the selected symbols. Wins may begin on any reel, and pay top to bottom on adjacent reels. In some embodiments, highest win is paid per line. In other embodiments, all wins pay per line.

In some embodiments, each of the horizontal reels 704, 708, 712 includes a first set of symbols, while each of the horizontal reels 706, 710 includes a second set of symbols. For example, the first set of symbols includes a plurality of pictorial, character, and/or letter symbols, a plurality of block symbols, and a plurality of blank spaces. The second set of symbol includes a plurality of pictorial, character, and/or letter symbols, a plurality of block symbols, a plurality of blank spaces, and a plurality of wild symbols. The primary difference between the first and second sets of symbols is that the second set of symbols includes the plurality of wild symbols. In other embodiments, all of the horizontal reels 704, 706, 708, 710, 712 include the second set of symbols. In still other embodiments, all of the horizontal reels 704, 706, 708, 710, 712 include the first set of symbols. In yet other embodiments, only one of the horizontal reels 704, 706, 708, 710, 712 includes the second set of symbols, while others of the horizontal reels 704, 706, 708, 710, 712 include the first set of symbols. The reels contain one or more predetermined positions having symbols that may be replaced by randomly selected symbols at a start of a spin. The symbols that may replace the symbols at the predetermined positions may be selected to only include the pictorial, character, and/or letter symbols.

In some cases, the symbol data memory module 64.1 (of FIG. 6) store values of the wild symbols. For example, the wild symbols may either be a 2× wild symbol or a 3× wild symbol. Wild symbols may substitute for any of the pictorial symbols. Wild symbols may only substitute for one symbol per spin. Wild symbols in a winning combination will multiply the winning combination by the multiplier. Two wild symbols in a winning combination will multiply the winning combination by a product of the respective multipliers.

Figure 8A:
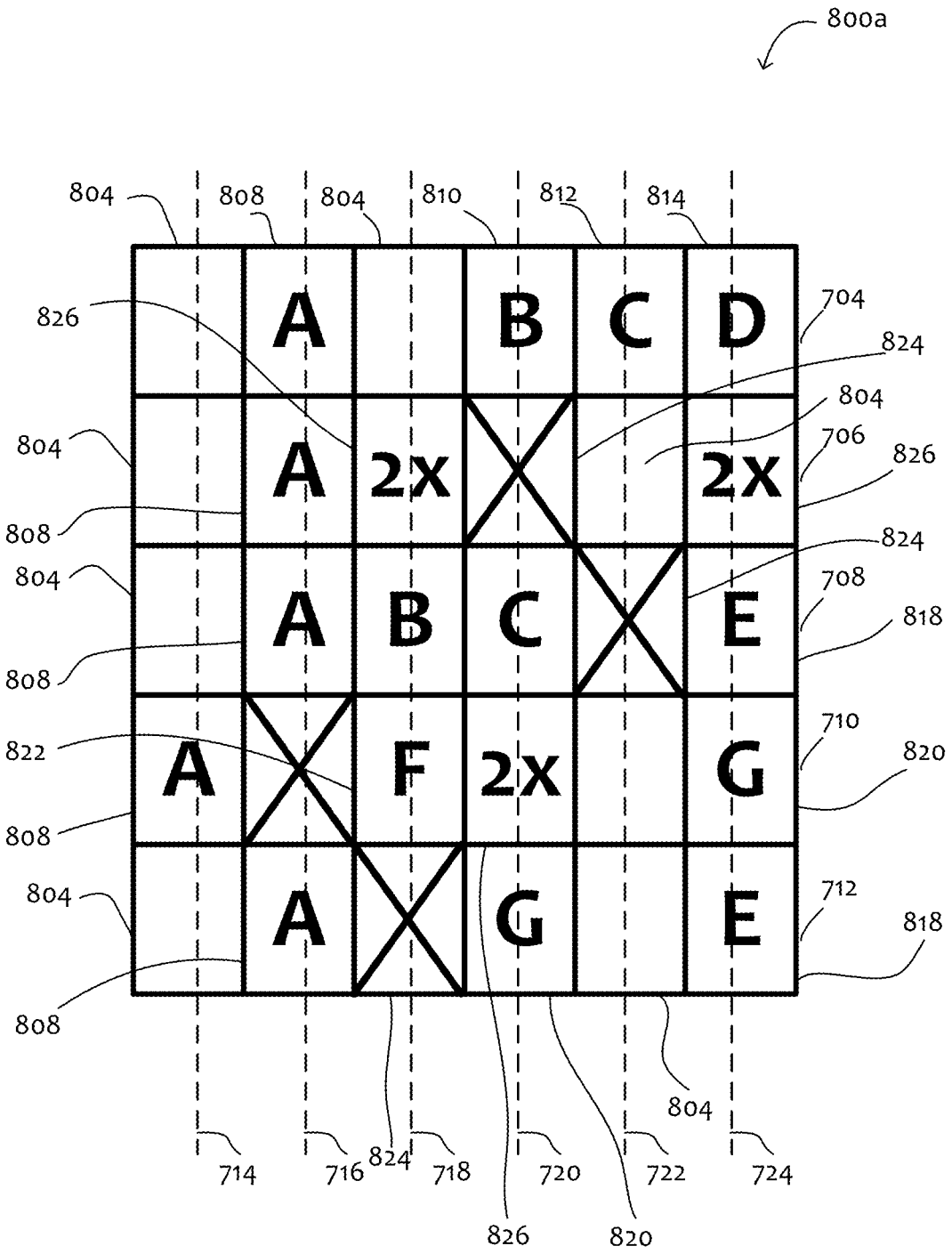
FIG. 8A illustrates an exemplary game outcome in accordance with various aspects of the present disclosure.

FIG. 8A illustrates an exemplary game outcome 800*a* with horizontal reels 704, 706, 708, 710, 712 with six vertical play lines 714, 716, 718, 720, 722, 724. In the embodiment shown, each of the horizontal reels 704, 708, 712 includes the first set of symbols that includes a plurality of pictorial, character, and/or letter symbols, a plurality of block symbols, and a plurality of blank spaces as discussed above. Each of the horizontal reels 706, 710 includes the second set of symbols that includes a plurality of pictorial, character, and/or letter symbols, a plurality of block symbols, a plurality of blank spaces, and a plurality of wild symbols as discussed above. As shown, the symbol select controller 625*a* has randomly selected a plurality of symbols from the symbol data memory module 64.1 for display on the display 54. The selected symbols include a plurality of blank spaces 804, a plurality of letter symbols 808, 810, 812, 814, 818, 820, 822, a plurality of blocks or block symbols 824, and a plurality of wild multipliers 826. The display controller 621 populates each of the horizontal reels 704, 706, 708, 710, 712 with the selected symbols.

Play line 714 shows four blank spaces 804 on reels 704, 706, 708, 712, and a letter symbol 808 on reel 710. Play line 716 shows four letter symbols 808 "A" on reels 704, 706, 708, 712, three of the four letter symbols 808 are adjacent to each other on the play line 716. Since play line 714 includes a number of blank spaces 804, the symbol shift controller 625*c* may determine that the letter symbols 808 on play line 716 can be shifted or moved to the blank spaces 804 on play line 714, if the evaluation controller 625*b* determines that shifting the letter symbols 808 on reels 704, 706, 708, 712 to the blank spaces 804 on reels 704, 706, 708, 712 of play line 714 results in an optimal win. For example, the evaluation controller 625*b* evaluates all possible combinations of symbol shifts and the corresponding outcomes of each of the possible combinations to determine which arrangement of shifted symbols provides the largest possible award (i.e., the optimal win). In the embodiment shown, shifting the letter symbols 808 from reels 704, 706, 708, 712 to the blank spaces 804 on play line 714 results in a five of a kind of letter symbols 808 on play line 714, which may correspond with an optimal win. In an exemplary embodiment, the shifting process is animated to show each of the symbols sliding from its starting position to its final destination such that the user may visualize the shifting symbols as the shift occurs. For example, the non-blank symbols 808, 810, 812, 814, 818, 820, 822, 824, 826 may slide within the reels 704, 706, 708, 710, 712 to take the place of former blank symbols or spaces 804. In certain embodiments, one or more of the positions vacated by non-blank symbols 808, 810, 812, 814, 818, 820, 822, 824, 826 becomes a blank space or symbol 804.

Figure 8B:
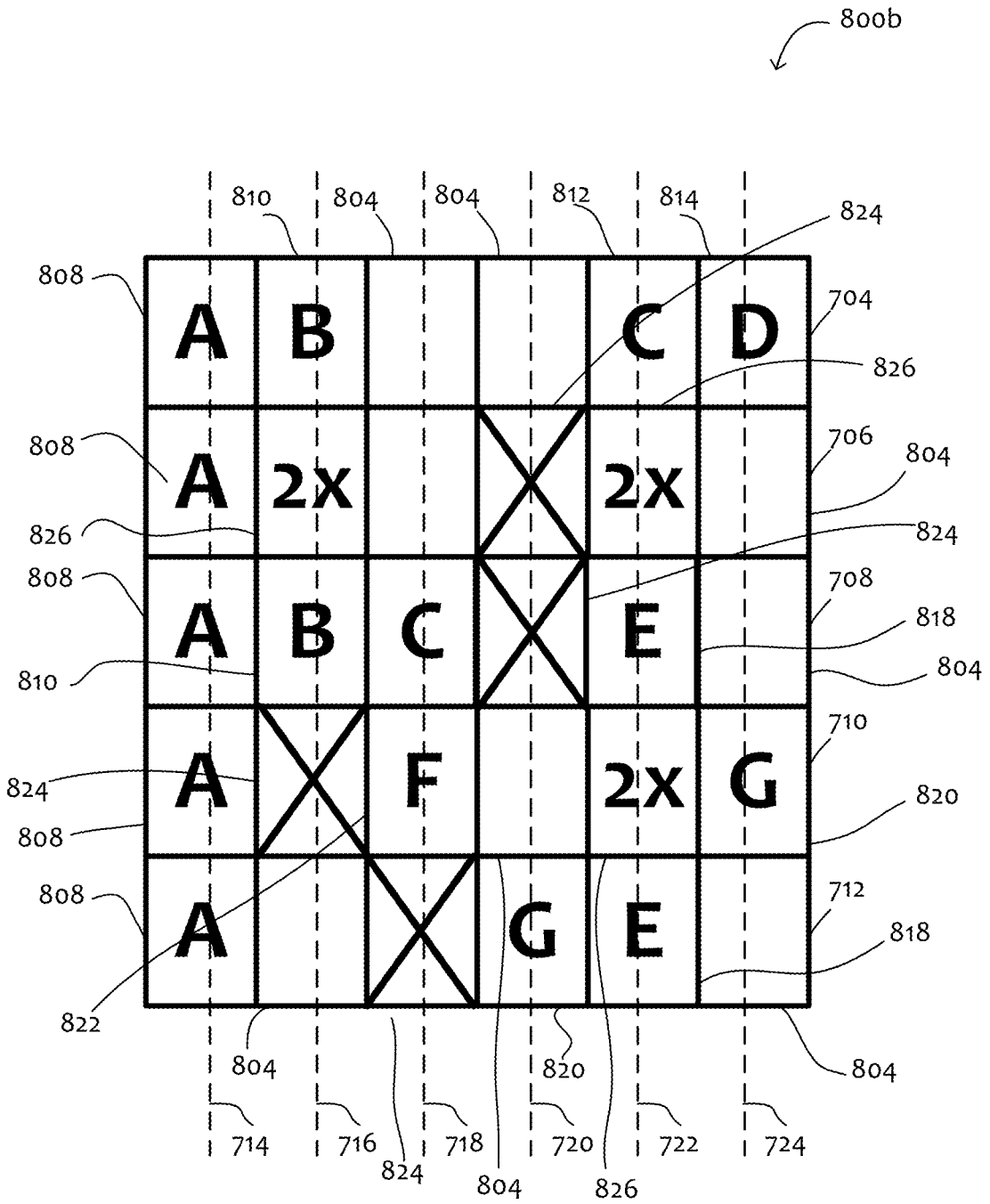
FIG. 8B illustrates an exemplary shifted game outcome in accordance with various aspects of the present disclosure.

FIG. 8B illustrates a first exemplary shifted game outcome 800*b* resulting from shifting the letter symbols 808 (of FIG. 8A) from reels 704, 706, 708, 712 of play line 716 to the blank spaces 804 on reels 704, 706, 708, 712 of play line 714. Shifting the letter symbols 808 thus results in a five-of-a-kind winning combination (5 A's) on play line 714.

Similarly, for example, after shifting the letter symbols 808 from reels 704, 706, 708, 712 of play line 716 to the blank spaces 804 on reels 704, 706, 708, 712 of play line 714, the symbol shift controller 625*c* may shift or move the letter symbols 810 "B" on play line 720 to the blank spaces 804 on play line 716, leaving two consecutive blank spaces on reel 704 on play lines 718, 720 based on the determination from the evaluation controller 625*b* of the optimal winning combination. The symbol shift controller 625*c* may continue to shift or move the 2× wild symbol 826 "B" on play line 718 of reel 706 to the blank space 804 on play line 716 of reel 706, leaving one blank space on reel 706 on play line 718. Similarly, on reel 708, the symbol shift controller 625*c* may continue to shift or move the letter symbol 810 "B" of play line 718 to the blank space 804 on play line 716. Thus, shifting the letter symbol 810 "B" from play line 720 to play line 716 on reel 704, the 2× wild symbol from play line 718 to play line 716 on reel 706, and the letter symbol 810 "B" from play line 718 to play line 716 on reel 706, results in three-of-a-kind and a 2× wild winning combination (3 B's and 2×) on play line 716, which may correspond with the optimal win determined by the evaluation controller 625*b*.

Similarly, on reel 706, the symbol shift controller 625*c* may continue to shift or move the 2× wild symbol 826 on play line 724 into the blank space 804 on play line 722, after the letter symbol 808 "A" moves from play line 716 to play line 714. On reel 708, the blank space 804 on play line 714 of reel 708 pushes the letter symbols "B" 810 "C" 812 and "E" 818 of reel 708 to shift or move from play lines 718, 720, 724, to play lines 716, 718, 722, respectively, while also moving block symbol 824 one play line, after the letter symbol 808 "A" moves from play line 716 to play line 714. On reel 710, the symbol shift controller 625*c* may continue to shift or move the 2× wild symbol 826 on play line 720 into the blank space 804 on play line 722. On reel 712, the symbol shift controller 625*c* may shift or move the letter symbol 818 "E" on play line 724 into the blank space 804 on play line 722. Thus, shifting the 2× wild symbol 826 from play line 724 to play line 722 on reel 706, the letter symbol 818 "E" from play line 724 to play line 722 on reel 708, the 2× wild symbol 826 from play line 720 to play line 722 on reel 710, and the letter symbol 818 "E" from play line 724 to play line 722 on reel 712, results in four-of-a-kind and two 2× wilds winning combination (2 E's and 4×) on play line 722, since the two 2× wilds result in a 4× wild, which may correspond with the optimal win determined by the evaluation controller 625*b*.

Figure 8C:
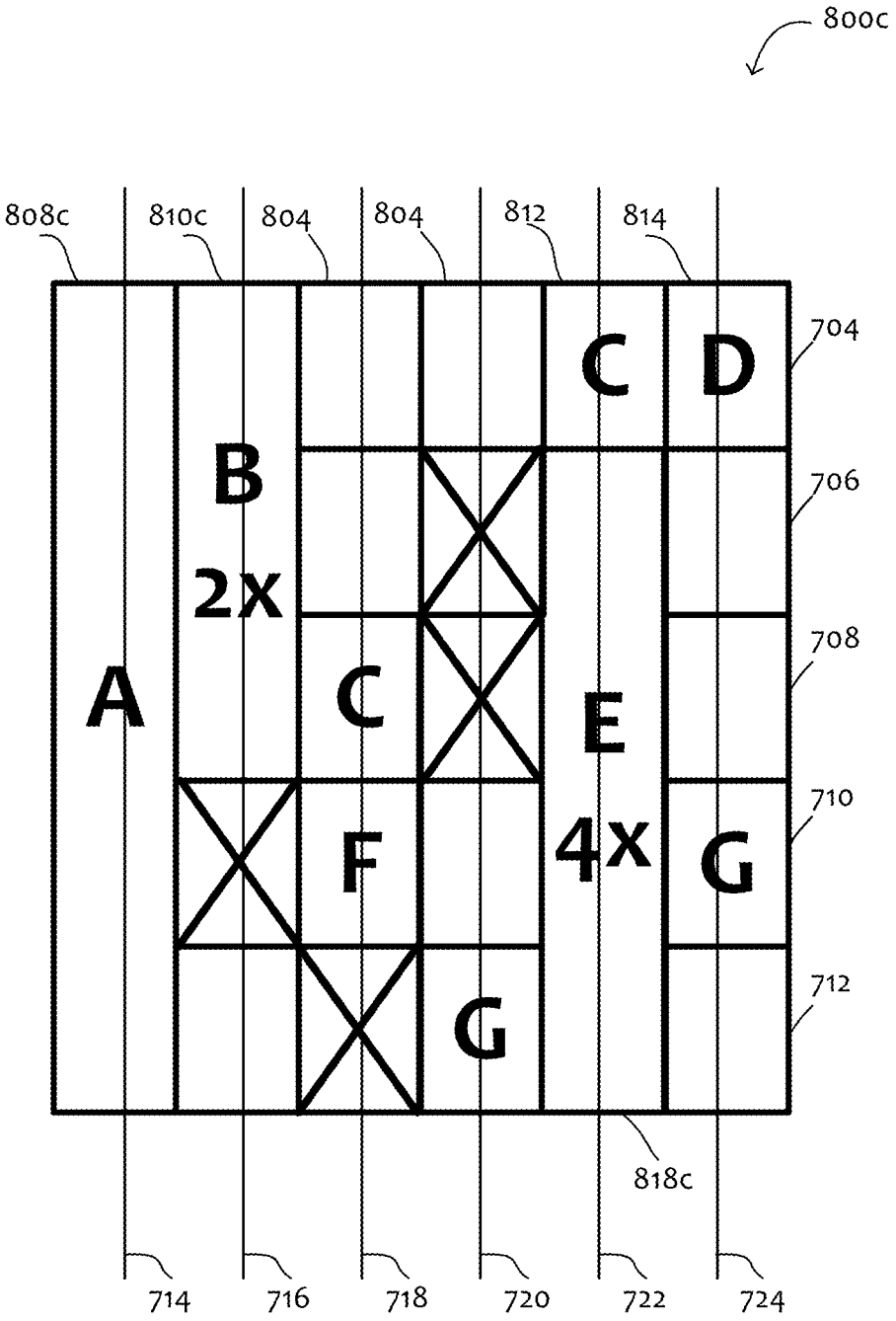
FIG. 8C illustrates a final exemplary game outcome in accordance with various aspects of the present disclosure.

FIG. 8C illustrates a final exemplary game outcome 800*c*. In the embodiment shown, the final exemplary game outcome 800*c* includes a merged column of a letter symbol "A" 808*c* on play line 714. The exemplary game outcome 800*c* also includes a merged column of a letter symbol "B" with a 2× wild 810*c* on play line 716. Similarly, the exemplary game outcome 800*c* also includes a merged column of a letter symbol "E" with a 4× wild 818*c* on play line 722. In an exemplary embodiment, the merging process is animated to show each vertical stack of adjacent matching and/or wild symbols transforming to a merged symbol such that the user may visualize the merging symbols as the merge occurs. For example, the five of a kind of "A" letter symbols 808 on play line 714 may transform from five individual matching "A" letter symbols 808 to a single "A" letter symbol 808*c* spanning the five display positions formerly occupied by the five individual matching "A" letter symbols 808.

Figure 9A:
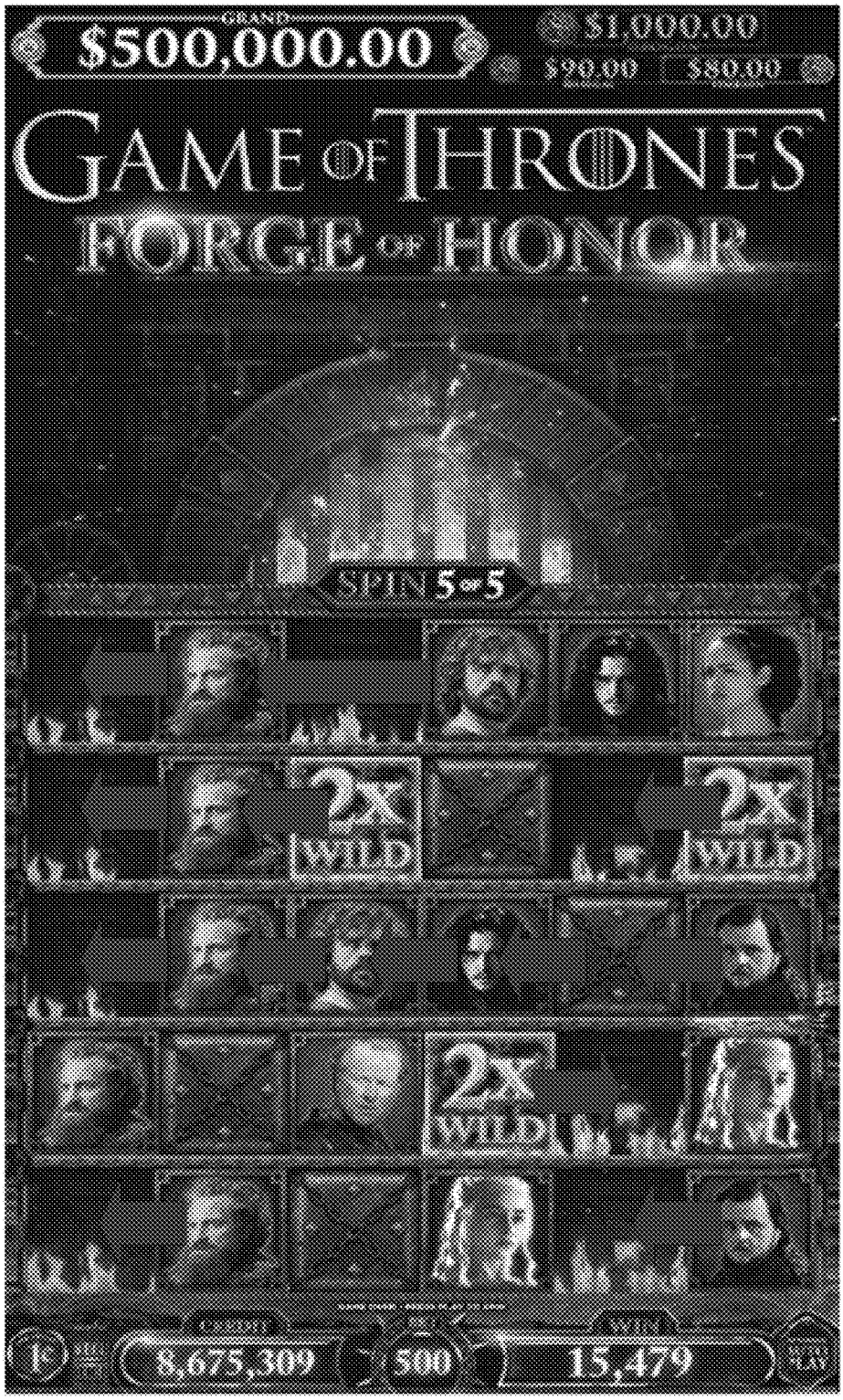
FIG. 9A illustrates a first exemplary screen of the game outcome of FIG. 8A with pictorial symbols in accordance with various aspects of the present disclosure.
Figure 9B:
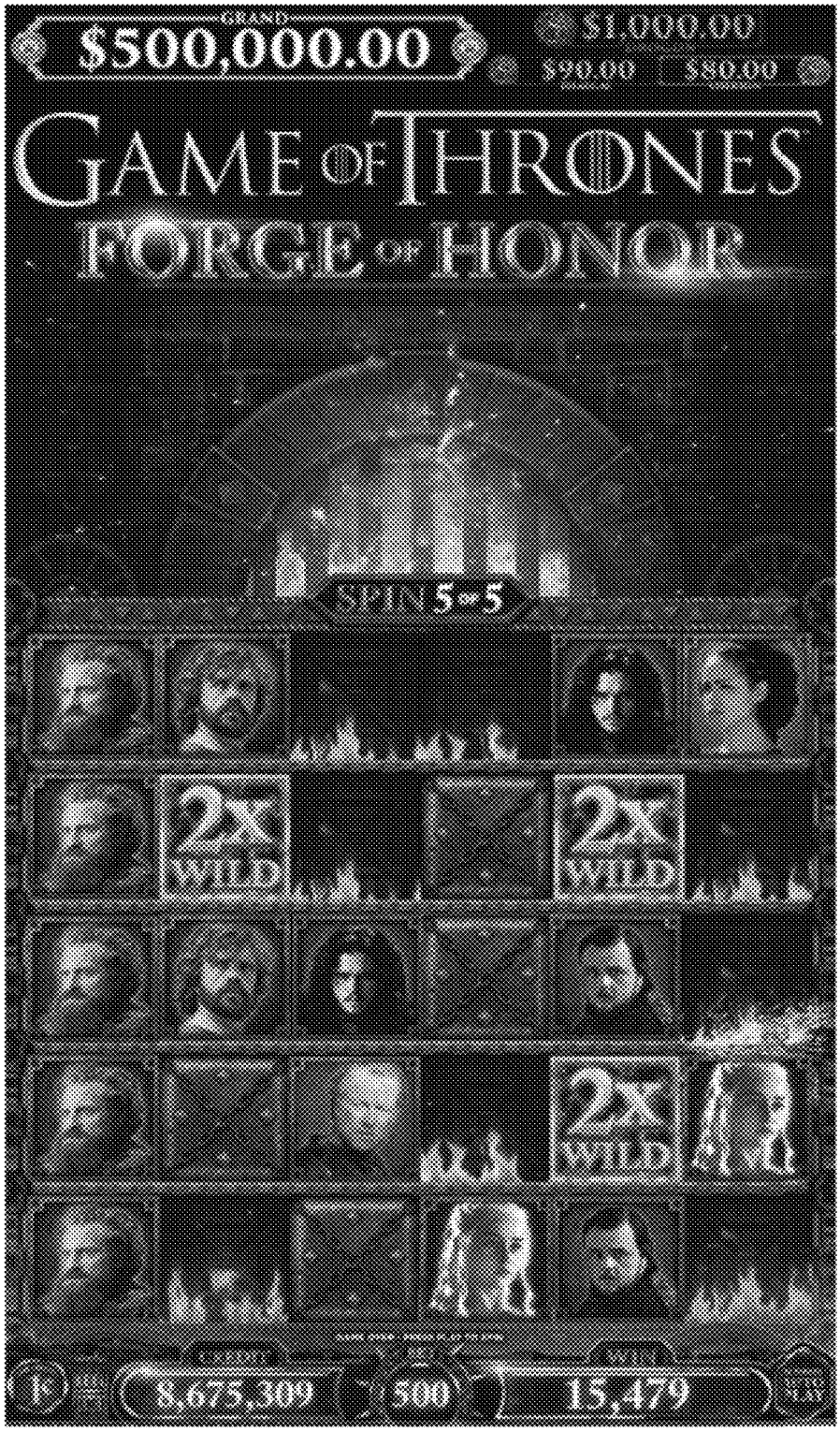
FIG. 9B illustrates a second exemplary screen of the shifted game outcome of FIG. 8B with pictorial symbols in accordance with various aspects of the present disclosure.
Figure 9C:
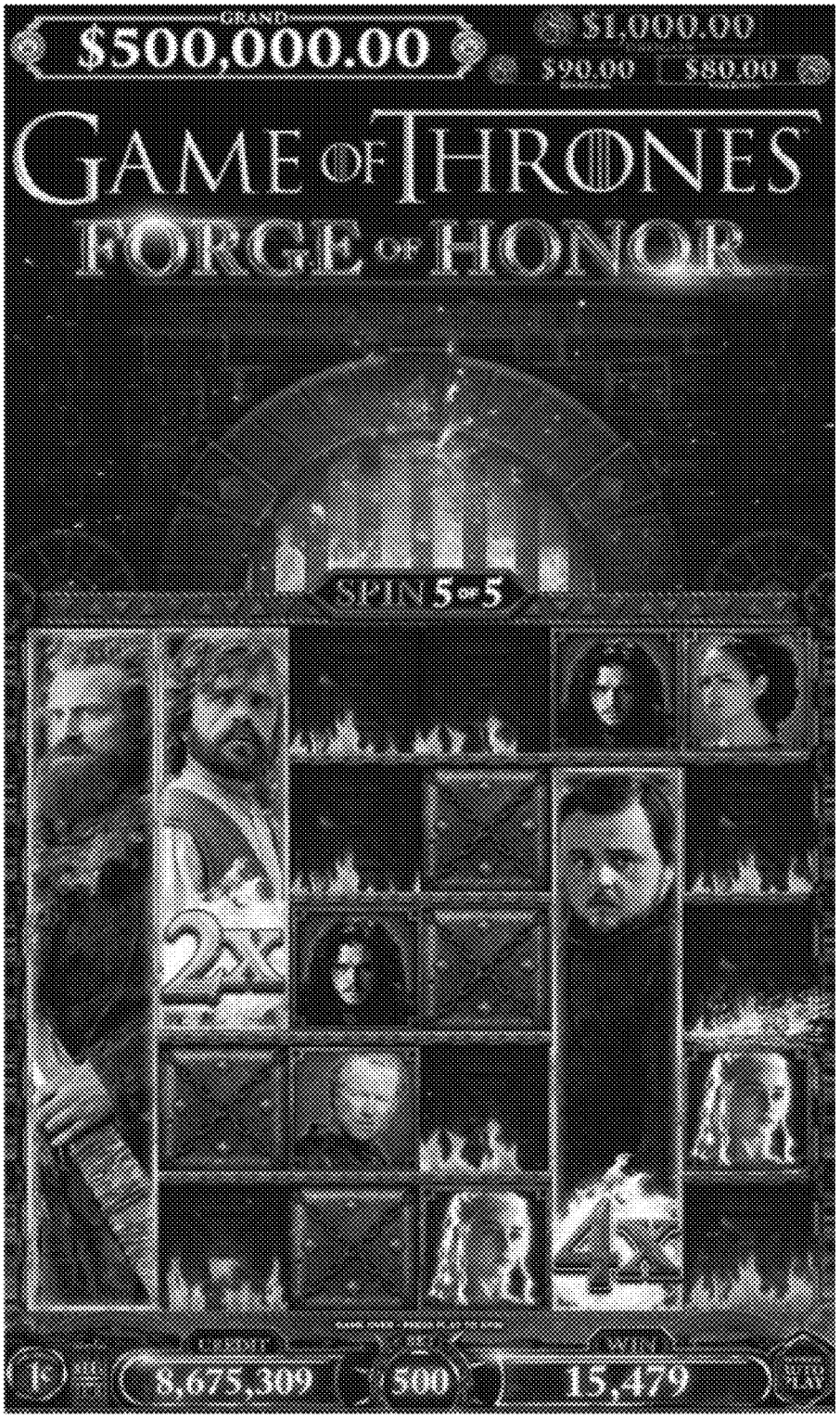
FIG. 9C illustrates a final exemplary screen of the final game outcome of FIG. 8C with pictorial symbols in accordance with various aspects of the present disclosure.

FIG. 9A illustrates a first exemplary screen of the game outcome 800*a* of FIG. 8A as described above but with pictorial symbols. FIG. 9B illustrates a second exemplary screen of the shifted game outcome 800*b* of FIG. 8B as described above but with pictorial symbols. FIG. 9C illustrates a final exemplary screen of the final game outcome 800*c* of FIG. 8C as described above but with pictorial symbols in accordance with various aspects of the present disclosure. As shown in FIGS. 9A-C, the game may be associated with a theme. For example, FIGS. 9A-C are screenshots of the Forge of Honor feature game within a GAME OF THRONES electronic gaming machine by ARISTOCRAT.

Figure 10:
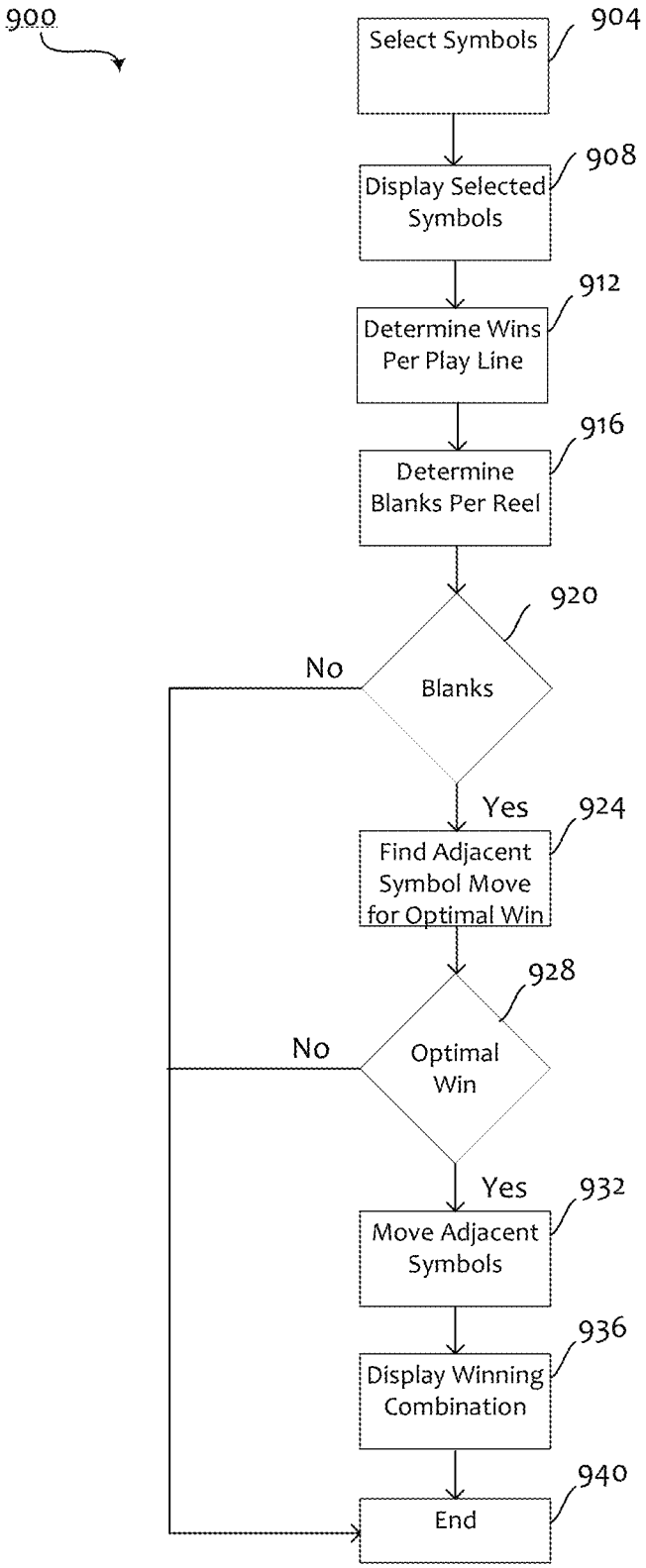
FIG. 10 illustrates a flow chart of a symbol shifting process of a game in accordance with various aspects of the present disclosure.

FIG. 10 illustrates a flow chart of a symbol shifting process 900 during a game. The game may be a standalone game or a bonus game launched from a primary game, among other things. The game is a spinning reel game having a number of reels each having a number of display positions. For example, the spinning reel game may have five reels each having six display positions forming an array of five rows and six columns as illustrated in FIGS. 7-9.

At block 904, the symbol select controller 625*a* (of FIG. 6) selects a plurality of symbols from the symbol data memory module 64.1 (of FIG. 6). At 908, the display controller 621 causes the display 54 (of FIG. 6) to display the selected symbols.

At block 912, the symbol shifting process 900 determines if the displayed symbols form any winning combination. Although not shown, the symbol shifting process 900 also causes the payout mechanism 52.2 (of FIG. 6) to pay an award corresponding to the winning combination based on the pay tables. At block 916, the symbol shifting process 900 determines if the displayed symbols include any blank spaces or symbols. If the symbol shifting process 900 determines that the displayed symbols do not include a blank space or symbol in block 920, the symbol shifting process 900 ends at block 940.

If the symbol shifting process 900 determines that there are one or more blanks to check at block 920, the symbol shifting process 900 determines if any movements in neighboring symbols will result in an optimal win at block 924. For example, all possible combinations of symbol shifts and the corresponding outcomes of each of the possible combinations is evaluated to determine which arrangement of shifted symbols provides the largest possible award (i.e., the optimal win). At block 928, if the symbol shifting process 900 determines that no movements will result in an optimal win in block 924, the symbol shifting process 900 ends at block 940. At block 928, if the symbol shifting process 900 determines that a symbol shift in neighboring symbols will result in an optimal win in block 924, the symbol shifting process 900 causes the symbol shift to occur in the neighboring symbols at block 932. At block 936, the display controller 621 causes the display 54 to display the shifted combinations of symbols. In some embodiments, the shifted combinations of symbols are highlighted as discussed above. For example, each vertical stack of adjacent matching and/or wild symbols may be transformed to a corresponding merged symbol to highlight the optimal win. The symbol shifting process 900 terminates at step 940.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art will appreciate that program code provides a series of instructions executable by the processor.

It will be understood to persons skilled in the art of the invention that many modifications may be made without departing from the spirit and scope of the invention. In particular, it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A gaming device comprising:

a credit input mechanism configured to receive a credit value that increases a credit balance of a credit meter;

a display device comprising a plurality of reels presented along the display device, wherein each reel presents a row of display positions for presenting symbols, the symbols presented at the display positions comprising non-blank symbols and blank symbols; and a game controller configured to:

decrease the credit balance based on a wager;

spin the plurality of reels horizontally to obtain a first game outcome comprising an array of the symbols in a first arrangement at the display positions, the symbols in the first arrangement based on one or more random outcomes generated from a random number generator;

determine whether the first arrangement of the symbols includes one or more of the blank symbols; and in response to a determination that the first arrangement of the symbols includes one or more of the blank symbols:

determine whether shifting one or more of the non-blank symbols horizontally in either direction with respect to the one or more of the blank symbols in each reel results in a second game outcome comprising a second arrangement of the symbols at the display positions corresponding with an award outcome greater than an award outcome for the first arrangement of symbols;

animate a horizontal shift of the one or more of the non-blank symbols with respect to the one or more of the blank symbols in each reel to obtain the second game outcome in response to a determination that the shifting results in the award outcome greater than the award outcome for the first arrangement of symbols; and increase the credit balance by the award outcome associated with the second arrangement of the symbols.

2. The gaming device of claim 1, wherein the game controller is configured to:

determine whether the first game outcome forms a win, and in response to a determination that the first game outcome forms the win, increase the credit balance by an award associated with the win.

3. The gaming device of claim 1, wherein the game controller is configured to maintain a sequential order of the non-blank symbols on each reel during the horizontal shift.

4. The gaming device of claim 1, wherein the second game outcome corresponds with the arrangement of the symbols in one or more of a plurality of vertical play lines of the plurality of reels.

5. The gaming device of claim 1, wherein the game controller is configured to merge a winning combination of non-blank symbols corresponding with the second game outcome into a single special symbol spanning a plurality of adjacent display positions.

6. The gaming device of claim 1, wherein:

the non-blank symbols comprise one or more multiplier symbols, and the second game outcome, corresponding with a winning combination of non-blank symbols including the one or more multiplier symbols, is multiplied by the one or more multiplier symbols in the winning combination to determine the award outcome associated with the second arrangement of the symbols.

7. The gaming device of claim 1, wherein the plurality of reels is disposed vertically along the display device, and wherein each reel presents a horizontal row of the symbols.

8. A method of playing a wagering game via a gaming system having a game controller, a display device, and a credit input mechanism configured to receive a credit value that increases a credit balance of a credit meter, the method comprising:

presenting a plurality of reels along the display device, wherein each reel presents a row of display positions for presenting symbols, the symbols presented at the display positions comprising non-blank symbols and blank symbols;

presenting on the display device that the credit balance decreases the credit balance based on a wager;

animating, using the display device, spinning of the plurality of reels horizontally to obtain a first game outcome comprising an array of the symbols in a first arrangement at the display positions;

animating, using the display device, a horizontal shift of the one or more of the non-blank symbols with respect to the one or more of the blank symbols in one or more of the reels to obtain a second game outcome, wherein the second game outcome comprises a second arrangement of the symbols at the display positions corresponding with an award outcome that exceeds an award outcome for the first arrangement of symbols; and presenting on the display device an adjustment of the credit balance being displayed by the award outcome of the second arrangement of the symbols.

9. The method of claim 8, comprising presenting on the display device an increase of the credit balance by an award associated with a win of the first game outcome when the first game outcome forms the win.

10. The method of claim 8, comprising maintaining on the display device a sequential order of the non-blank symbols on each reel during the horizontal shift.

11. The method of claim 8, wherein the second game outcome corresponds with the arrangement of the symbols in one or more of a plurality of vertical play lines of the plurality of the reels.

12. The method of claim 8, comprising merging on the display device a winning combination of non-blank symbols corresponding with the second game outcome into a single special symbol spanning a plurality of adjacent display positions.

13. The method of claim 8, wherein the award outcome of the second arrangement of the symbols is based on the second game outcome multiplied by one or more multiplier symbols of the non-blank symbols in a winning combination of non-blank symbols.

14. The method of claim 8, wherein the plurality of reels is disposed vertically along the display device, and wherein each reel presents a horizontal row of the symbols.

15. A gaming system, comprising a gaming server operatively coupled to a gaming device via a network, wherein the gaming device comprises a display device, the gaming server configured to:

cause the display device to present a plurality of reels, wherein each reel presents a row or column of display positions for presenting symbols, the symbols presented at the display positions comprising non-blank symbols and blank symbols;

cause the display device to present a decrease of a credit balance based on a wager;

cause the display device to present a spin animation that spins the plurality of reels horizontally to obtain a first game outcome comprising an array of the symbols in a first arrangement at the display positions, the symbols in the first arrangement based on one or more random outcomes generated from a random number generator;

determine whether the first arrangement of the symbols includes one or more of the blank symbols; and based on a determination that the first arrangement of the symbols includes one or more of the blank symbols:

determine whether shifting one or more of the non-blank symbols horizontally in either direction with respect to the one or more of the blank symbols in each reel results in a second game outcome comprising a second arrangement of the symbols at the display positions corresponding with an award outcome larger than an award outcome for the first arrangement of symbols;

cause the display device to animate a horizontal shift of the one or more of the non-blank symbols with respect to the one or more of the blank symbols in each reel to obtain the second game outcome based on a determination that the shifting results in the award outcome larger than the award outcome for the first arrangement of symbols; and cause the display device to present a modification of the credit balance by the award outcome of the second arrangement of the symbols.

16. The gaming system of claim 15, wherein the gaming server is configured to:

determine whether the first game outcome forms a win, and based on a determination that the first game outcome forms the win, cause the display device to present an adjustment of the credit balance by an award associated with the win.

17. The gaming system of claim 15, wherein the gaming server is configured to cause the display device to maintain a sequential order of the non-blank symbols on each reel during the horizontal shift.

18. The gaming system of claim 15, wherein the second game outcome corresponds with the arrangement of the symbols in one or more of a plurality of vertical play lines of the plurality of reels.

19. The gaming system of claim 15, wherein the gaming server is configured to cause the display device to merge a winning combination of non-blank symbols corresponding with the second game outcome into a single special symbol spanning a plurality of adjacent display positions.

20. The gaming system of claim 15, wherein:

the non-blank symbols comprise one or more multiplier symbols, and the second game outcome, corresponding with a winning combination of non-blank symbols including the one or more multiplier symbols, is multiplied by the one or more multiplier symbols in the winning combination to determine the award outcome associated with the second arrangement of the symbols.

* * * * *